US009434084B2

(12) United States Patent
Osborne Odio

(10) Patent No.: US 9,434,084 B2
(45) Date of Patent: Sep. 6, 2016

(54) METHOD OF CONVERTING A TIRE INTO CLADDING COMPONENTS

(71) Applicant: John Carlos Osborne Odio, Playa Tamarindo (CR)

(72) Inventor: John Carlos Osborne Odio, Playa Tamarindo (CR)

(73) Assignee: NLIGHTGLOBAL S.A. (CR)

( * ) Notice: Subject to any disclaimer, the term of this patent is extended or adjusted under 35 U.S.C. 154(b) by 135 days.

(21) Appl. No.: 14/024,815

(22) Filed: Sep. 12, 2013

(65) Prior Publication Data

US 2015/0068006 A1 Mar. 12, 2015

(51) Int. Cl.

| | |
|---|---|
| ***B26D 3/00*** | (2006.01) |
| ***B26D 3/24*** | (2006.01) |
| ***E04D 1/10*** | (2006.01) |
| *E04D 5/08* | (2006.01) |

(52) U.S. Cl.

CPC ..... *B26D 3/005* (2013.01); *B26D 3/24* (2013.01); *E04D 1/10* (2013.01); *E04D 5/08* (2013.01); *Y10T 29/49716* (2015.01); *Y10T 29/49826* (2015.01); *Y10T 83/041* (2015.04); *Y10T 83/0524* (2015.04)

(58) Field of Classification Search

CPC ..... B26D 3/005; B26D 3/24; E04D 1/10; E04D 5/08; E04D 1/00; E04D 3/36; Y10T 83/041; Y10T 83/0524; Y10T 29/49716; Y10S 83/951; Y10S 83/92

USPC ..... 52/748.1, DIG. 9

See application file for complete search history.

(56) References Cited

U.S. PATENT DOCUMENTS

| | | | | |
|---|---|---|---|---|
| 3,803,792 | A * | 4/1974 | Fulton | 52/533 |
| 3,922,942 | A * | 12/1975 | Fawcett et al. | 83/620 |
| 5,086,552 | A * | 2/1992 | Moore | 29/403.1 |
| 5,258,222 | A | 11/1993 | Crivelli | |
| 5,527,409 | A | 6/1996 | Lanphier | |
| 5,675,954 | A * | 10/1997 | Garcia | 52/518 |
| 5,873,208 | A * | 2/1999 | Nowacek | 52/518 |
| 6,151,859 | A * | 11/2000 | Nowacek | 52/518 |
| 6,194,519 | B1 | 2/2001 | Blalock et al. | |
| 6,706,132 | B2 * | 3/2004 | Coffin | 156/87 |
| 2003/0024369 | A1 * | 2/2003 | Dunn et al. | 83/733 |
| 2003/0106402 | A1 * | 6/2003 | Solon | 83/19 |

OTHER PUBLICATIONS

International Search Report of the International Searching Authority (USPTO) for international application PCT/US2014/053684 dated Dec. 24, 2014, Receipt date: Mar. 15, 2015.

Written Opinion of the International Searching Authority (USPTO) for international application PCT/US2014/053684 dated Dec. 24, 2014.

* cited by examiner

*Primary Examiner* — David Bryant
*Assistant Examiner* — Lawrence Averick
(74) *Attorney, Agent, or Firm* — Basil M. Angelo

(57) ABSTRACT

A method of converting a tire into cladding components includes removing a first sidewall and a second sidewall of the tire from a tread ring of the tire. The first sidewall and the second sidewall are cut radially forming a plurality of shingles. The tread ring is cut transversely forming a plurality of mounting struts. A method of manufacturing a cladding includes fastening at least two mounting struts to a structure. A plurality of interior-facing shingles are fastened to the structure in a mounting groove formed by the at least two mounting struts. A plurality of exterior-facing shingles are fastened to the structure through the at least two mounting struts.

8 Claims, 10 Drawing Sheets

METHOD OF CONVERTING A TIRE INTO CLADDING COMPONENTS

BACKGROUND OF THE INVENTION

Cladding is a protective and/or aesthetic layer of material that covers an underlying structure. When used as a protective layer, cladding serves as a barrier between the environment and the underlying structure. The cladding may protect the underlying structure from harsh weather conditions including wind, rain, hail, and/or snow. In addition, the cladding may insulate the underlying structure from conditions outside the structure. When used as an aesthetic layer, cladding serves as an aesthetically pleasing decoration of the underlying structure. In this way, the cladding may improve the aesthetic appeal of an interior or exterior panel or roof of the underlying structure. In many instances, cladding serves both a protective and aesthetic purpose.

Conventional cladding used for roofing includes asphalt, concrete, ceramic, wood, clay, metal, rubber, and slate claddings. While some conventional claddings such as, for example, cedar wood, are sourced from renewable resources and made in an ecologically friendly process, they are typically very expensive and suffer from one or more performance issues. As a consequence, manufactured claddings enjoy widespread use. In the United States, asphalt cladding is the predominate cladding used for roofing because of its long service life and comparatively low cost. However, asphalt cladding is made from petroleum or petroleum by-products, a non-renewable resource, in a process that is not ecologically friendly.

BRIEF SUMMARY OF THE INVENTION

According to one aspect of one or more embodiments of the present invention, a method of converting a tire into cladding components includes removing a first sidewall and a second sidewall of the tire from a tread ring of the tire. The first sidewall and the second sidewall are cut radially forming a plurality of shingles. The tread ring is cut transversely forming a plurality of mounting struts.

According to one aspect of one or more embodiments of the present invention, a method of manufacturing a cladding includes fastening at least two mounting struts to a structure. A plurality of interior-facing shingles are fastened to the structure in a mounting groove formed by the at least two mounting struts. A plurality of exterior-facing shingles are fastened to the structure through the at least two mounting struts.

Other aspects of the present invention will be apparent from the following description and claims.

DETAILED DESCRIPTION OF THE INVENTION

Figure 1:
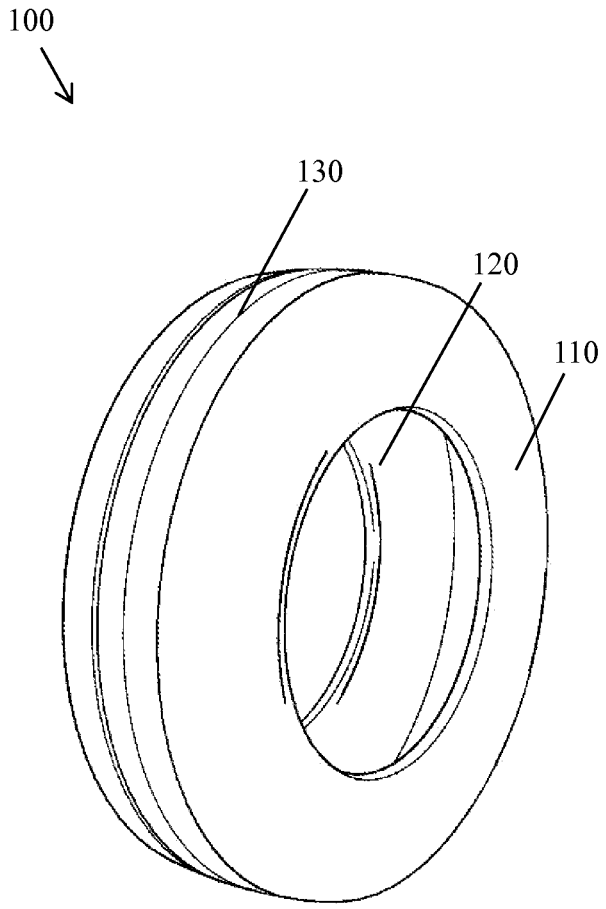
FIG. 1 shows a disposed tire in accordance with one or more embodiments of the present invention.

One or more embodiments of the present invention are described in detail with reference to the accompanying figures. For consistency, like elements in the various figures are denoted by like reference numerals. In the following detailed description of the present invention, specific details are set forth in order to provide a thorough understanding of the present invention. In other instances, well-known features to one of ordinary skill in the art are not described to avoid obscuring the description of the present invention.

A conventional tire provides traction between a vehicle and the road and provides some manner of cushion to the ride of the vehicle. The tire is typically a doughnut-shaped inflatable structure that is mounted to a rim of a wheel. The tire typically includes a tread portion that provides traction and sidewall portions that support compressed air disposed within a chamber formed by the tire and the rim of the wheel. The tire is typically composed of rubber, fabric, wire, and carbon black. When a vehicle's tires wear out, the tires are typically taken out of service and replaced by new tires.

Because of the large number of vehicles in use worldwide, the number of disposed tires increases on a daily basis. While there have been efforts to retread or otherwise repurpose disposed tires, millions of disposed tires are discarded and end up in stockpiles and landfills each year.

Because of the composition of disposed tires, they can take up to 2000 years to decompose. As such, the accumulation and the management of disposed tires is very expensive and poses several health and environmental risks. When disposed tires are stockpiled, disease carrying pests may nest in the cavities of the tires. In addition, mosquitoes may breed in stagnant rainwater that collects in the cavities of the tires. When disposed tires are stockpiled, they pose a serious fire safety risk that cannot be understated. While tires typically do not self-ignite, when they catch fire they are very difficult to extinguish because of their low thermal conductivity and torous geometry. As such, tire fires are typically uncontrollable and can burn for years. If not contained, tire fires can spread fire to the surrounding environment or structures. In addition, tire fires typically emit a thick smoke of various toxic and carcinogenic gases. As the smoke spreads, the toxic gases may be fatal to nearby inhabitants. As tire fires burn, the rubber of the tires may eventually melt. Once melted, the liquefied rubber portions of the tire may drip, run, or otherwise spread and, because of tackiness, adhere to whatever the liquefied rubber contacts. Even when extinguished, tire fires continue to pose a number of health and environmental risks. The location of the tire fire is typically covered in toxic chemicals that can contaminate food and water supplies. Typically, the location must be remediated at great expense before the location is suitable for human use.

The limited success of efforts to retread or otherwise repurpose disposed tires has largely been enjoyed by economically developed countries that have the political will and economic resources to implement such programs. As such, the accumulation of disposed tires, and the corresponding health and environmental risks they pose, have and continue to be felt strongest in lesser economically developed countries. Thus, a need exists to repurpose disposed tires in a cost-effective and ecologically friendly manner.

FIG. 1 shows a disposed tire in accordance with one or more embodiments of the present invention. Tire 100 includes a first sidewall 110, a second sidewall 120, and a tread ring 130. The first sidewall 110 may extend into a tread portion (not independently illustrated) of tire 100. The second sidewall 120 may extend into a tread portion (not independently illustrated) of tire 100. The tread ring 130 is a center of the tread portion (not independently illustrated) of tire 100 that does not extend into the first sidewall 110 or the second sidewall 120. Tire 100 may be composed of rubber (not independently illustrated), fabric (not independently illustrated), wire (not independently illustrated), and carbon black (not independently illustrated). In certain embodiments, tire 100 may be a passenger vehicle tire. In other embodiments, tire 100 may be a commercial vehicle tire. One of ordinary skill in the art will recognize that a type and a size of tire 100 may vary in accordance with one or more embodiments of the present invention.

In certain embodiments, tires 100 may be selected for use in a method of converting tires into cladding components based on one or more of a type and a size of the tire to maintain the approximate uniformity of shingles (not shown) and mounting struts (not shown) made out of tires 100. In other embodiments, tires 100 may be selected at random and approximately uniform shingles (not shown) and mounting struts (not shown) may be selected from those made out of tires 100. In still other embodiments, tires 100 may be selected at random and approximately uniform shingles (not shown) and mounting struts (not shown) may be formed by modifying the shingles (not shown) and mounting struts (not shown) during the manufacture of the cladding components (not shown). One of ordinary skill in the art will recognize that the way in which approximately uniform shingles (not shown) and mounting struts (not shown) are selected may vary in accordance with one or more embodiments of the present invention.

Figure 2:
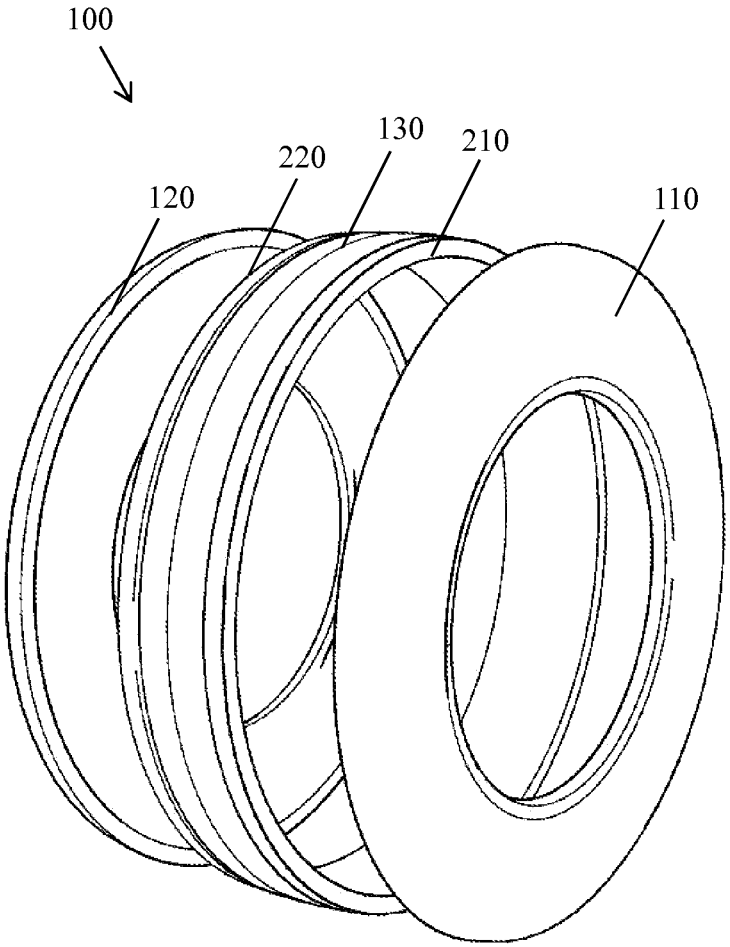
FIG. 2 shows the separation of the first and second sidewalls from the tread ring of the disposed tire in accordance with one or more embodiments of the present invention.

FIG. 2 shows the separation of the first and second sidewalls from the tread ring of the disposed tire in accordance with one or more embodiments of the present invention. The first sidewall 110 may be removed from the tread ring 130 at a circumferential location 210. The second sidewall 120 may be removed from the tread ring 130 at a circumferential location 220. In certain embodiments, the first sidewall 110 may be removed from the tread ring 130 at a circumferential location 210 that extends approximately 2 inches from the first sidewall portion into the tread portion (not independently illustrated) of tire 100 and the second sidewall 120 may be removed from the tread ring 130 at a circumferential location 220 that extends approximately 2 inches from the second sidewall portion into the tread portion (not independently illustrated) of tire 100. In this way, the first sidewall 110 and the second sidewall 120 each include a portion of tread (not independently illustrated) along their outer circumference. In other embodiments, the first sidewall 110 may be removed from the tread ring 130 at a circumferential location 210 that extends approximately 1 inch from the first sidewall portion into the tread portion (not independently illustrated) of tire 100 and the second sidewall 120 may be removed from the tread ring 130 at a circumferential location 220 that extends approximately 1 inch from the second sidewall portion into the tread portion (not independently illustrated) of tire 100. One of ordinary skill in the art will recognize that circumferential location 210 and circumferential location 220 may vary in accordance with a specific design or application. The portion of tread left on the first sidewall 110 and the portion of tread left on the second sidewall 120 may form a lip (not shown) on the shingles (not shown) eventually produced.

In certain embodiments, a cutting tool (not shown) or cutter (not shown) may be used to remove the first sidewall 110 and the second sidewall 120 from the tread ring 130. In other embodiments, a milling tool (not shown) may be used. In still other embodiments, a saw (not shown) may be used. One of ordinary skill in the art will recognize that any cutting mechanism suitable for removing the first sidewall 110 and the second sidewall 120 from the tread ring 130 may be used in accordance with one or more embodiments of the present invention.

Figure 3A:
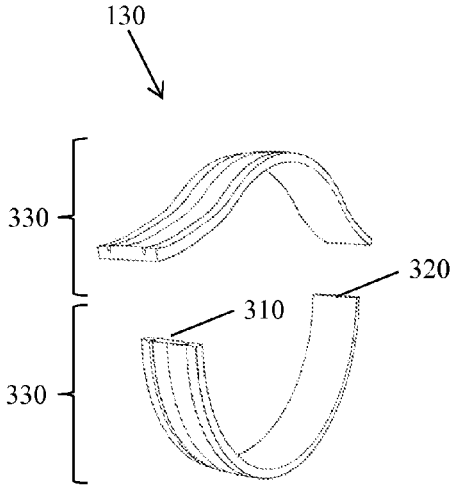
FIG. 3A shows a tread ring cut into a plurality of mounting struts in accordance with one or more embodiments of the present invention.
Figure 3B:
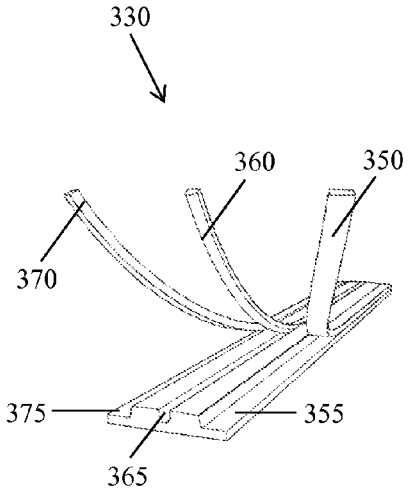
FIG. 3B shows removal of a longitudinal strip along a first edge, a center, and a second edge of a mounting strut in accordance with one or more embodiments of the present invention.

FIG. 3 shows a conversion of the tread ring into a plurality of mounting struts in accordance with one or more embodiments of the present invention. Continuing in FIG. 3A, tread ring 130 may be cut transversely, thereby forming a plurality of mounting struts 330. In certain embodiments, tread ring 130 may be cut transversely at location 310 and location 320 that are approximately equidistant apart. In this way, two mounting struts 330 of approximately equal length may be formed out of tread ring 130. In other embodiments, the tread ring may be cut transversely at a plurality of locations (not shown) that are approximately equidistant apart, forming a plurality of mounting struts (not shown) that are approximately equal in length. One of ordinary skill in the art will recognize that tread ring 130 may be cut transversely at different locations forming mounting struts of different lengths that may vary in accordance with a specific design or application.

While mounting strut 330 may be used without further modification, in certain embodiments, mounting strut 330 may be modified to facilitate the fastening of mounting strut 330 to an underlying structure (not shown) and/or to facilitate the fastening of shingles (not shown) to the mounting strut 330 itself or to the underlying structure (not shown) through the mounting strut 330. Continuing in FIG. 3B, in certain embodiments, a longitudinal strip 350 may be removed along a first edge (not independently illustrated) of mounting strut 330 forming a first edge groove 355 in mounting strut 330. In certain embodiments, a longitudinal strip 360 may be removed along a center (not independently illustrated) of mounting strut 330 forming a center groove 365 in mounting strut 330. In certain embodiments, a longitudinal strip 370 may be removed along a second edge (not independently illustrated) of mounting strut 330 forming a second edge groove 375 in mounting strut 330.

In certain embodiments, a groove forming tool (not used) may be used to remove longitudinal strips 350, 360, and 370. In other embodiments, a cutting tool (not shown) or cutter (not shown) may be used. In still other embodiments, a milling tool (not shown) may be used. One of ordinary skill in the art will recognize that any cutting mechanism suitable for removing longitudinal strips 350, 360, and 370 from the mounting strut 330 may be used in accordance with one or more embodiments of the present invention.

Figure 3C:
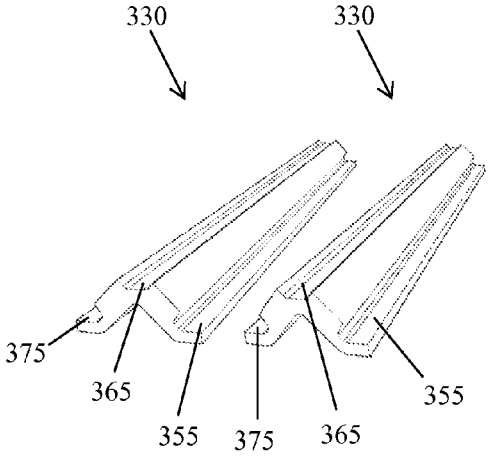
FIG. 3C shows a plurality of mounting struts bent along a center in accordance with one or more embodiments of the present invention.

Continuing in FIG. 3C, mounting strut 330 may be bent along center groove 365 such that a portion of mounting strut 330 protrudes longitudinally. In this way, a first edge groove 355 and a second edge groove 375 may be used to fasten a mounting strut 330 to an underlying structure (not shown) such that a portion of mounting strut 330 protrudes longitudinally. Once fastened, center groove 365 may be used as a centerline through which shingles (not shown) may more easily be fastened to mounting strut 330 or the underlying structure (not shown) through mounting strut 330. In the figure, two mounting struts 330 formed by cutting tread ring 130 transversely at locations 310 and 320 are depicted. One of ordinary skill in the art will recognize that the number of mounting struts 330 formed from tread ring 130 may vary based on the number of transverse cuts made.

Figure 4:
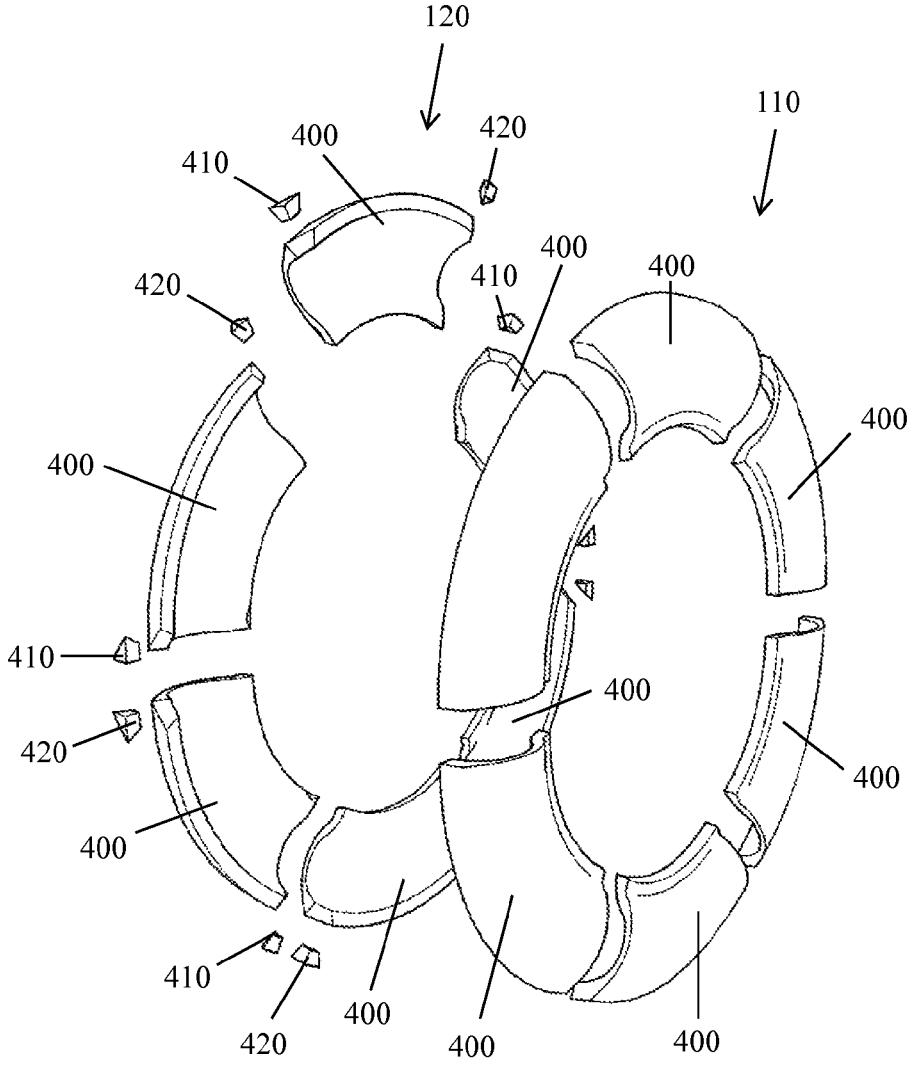
FIG. 4 shows a conversion of the first and second sidewalls into a plurality of shingles in accordance with one or more embodiments of the present invention.

FIG. 4 shows a conversion of the first and second sidewalls into a plurality of shingles in accordance with one or more embodiments of the present invention. First sidewall 110 may be cut radially forming a plurality of shingles 400. Second sidewall 120 may be cut radially forming a plurality of shingles 400. The radial cuts may be made along a plurality of lines that run through a center (not independently illustrated) of the circumference of each respective sidewall piece 110 and 120. In certain embodiments, twelve (12) shingles 400 may be formed by making six (6) radial cuts on the first sidewall 110 that are approximately equidistant apart and making six (6) radial cuts on the second sidewall 120 that are approximately equidistant apart. In other embodiments, a plurality of shingles 400 may be formed by making a corresponding plurality of radial cuts on each respective sidewall piece 110 and 120 that are approximately equidistant apart. One of ordinary skill in the art will recognize that the number of shingles 400 formed depends on the number of radial cuts made and may vary in accordance with a specific design or application. In addition, one of ordinary skill in the art will recognize that the size of the shingles may vary based on the spacing between the radial cuts and may vary in accordance with a specific design or application.

In certain embodiments, a cutting tool (not shown) or cutter (not shown) may be used to make the radial cuts forming the plurality of shingles 400. In other embodiments, a milling tool (not shown) may be used. In still other embodiments, a saw (not shown) may be used. One of ordinary skill in the art will recognize that any cutting mechanism suitable for making radial cuts may be used in accordance with one or more embodiments of the present invention.

As discussed above with respect to FIG. 2, the first sidewall 110 and the second sidewall 120 may be removed from the tread ring (130 of FIG. 2) at circumferential locations (210 and 220 of FIG. 2) that extend into the tread portion (not independently illustrated) of the tire (100 of FIG. 2). As such, the first sidewall 110 and the second sidewall 120 may each include a portion of tread (not independently illustrated) along their outer circumference (not independently illustrated). The portion of tread (not independently illustrated) left on the first sidewall 110 and the portion of tread let on the second sidewall 120 may form a lip (not independently illustrated) on the shingles 400 formed from each respective sidewall 110 and 120. In certain embodiments, one or more of a portion of tread tip 410 and a portion of tread tip 420 may be removed from the lip of one or more shingles 400. The portion of tread tip 410 and the portion of tread tip 420 may be removed by making a 45 degree angle cut with respect to the portion of tread of shingle 400 when looking at shingle 400 from the perspective of what would be the inside of the tire (100 of FIG. 2). The removal of the portions of tread tip 410 and 420 may improve the overlapping (not shown) of shingles 400 and the aesthetic appeal of the cladding produced (not shown) using shingles 400.

The shingles 400 and mounting struts 330 made out of the tire (100 of FIG. 2) may be used as cladding components for manufacturing a cladding or cladding panel. In certain embodiments, the cladding components may be used as cladding components for roofing. In other embodiments, the cladding components may be used as cladding components for a panel. In still other embodiments, the cladding components may be used as cladding components for a modular cladding panel configured to facilitate the assembly of a larger cladding. One of ordinary skill in the art will recognize that the use of the cladding components may vary based on a specific design or application.

In certain embodiments, an appearance of one or more shingles 400 may be altered by cutting an outward facing surface (not independently illustrated) and/or edge (not independently illustrated) of the one or more shingles 400. For example, the surface and/or edge may be straight-cut, scalloped, or pointed. In other embodiments, an appearance of one or more shingles 400 may be altered by shaving an outward facing surface and/or edge of the one or more shingles 400. In still other embodiments, an appearance of one or more shingles 400 may be altered by buffing an outward facing surface and/or edge of the one or more shingles 400. In still other embodiments, an appearance of one or more shingles 400 may be altered by heating an outward facing surface and/or edge of the one or more shingles. In this way, the outward facing surface (not independently illustrated) and/or edge may be altered to ensure an approximately uniform appearance of the one or more shingles 400 or provide an approximately uniform aesthetic look to the one or more shingles 400.

In certain embodiments, the above-noted alterations to the outward facing surfaces (not independently illustrated) and/or edges (not independently illustrated) of one or more shingles 400 may be performed prior to removal of the first and second sidewalls (110 and 120 of FIG. 2) from the tread ring (130 of FIG. 2). In other embodiments, the above-noted alterations to the outward facing surfaces and/or edges of one or more shingles 400 may be performed after removal of the first and second sidewalls (110 and 120 of FIG. 2) from the tread ring (130 of FIG. 2), but prior to cutting the respective sidewalls (110 and 120 of FIG. 2) into shingles 400. In still other embodiments, the above-noted alterations to the outward facing surfaces and/or edges of one or more shingles 400 may be performed on one or more shingles 400 after they are formed. One of ordinary skill in the art will recognize that the manner in which the outward facing surface and/or edge of shingles 400 may be altered may vary in accordance with one or more embodiments of the present invention.

Figure 5A:
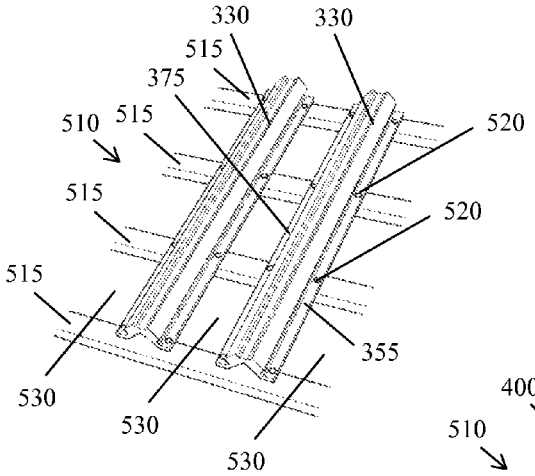
FIG. 5A shows a plurality of mounting struts fastened to a structure in accordance with one or more embodiments of the present invention.

FIG. 5 shows an assembly of cladding components in accordance with one or more embodiments of the present invention. As noted above, a tire (100 of FIG. 1) may be converted into a plurality of mounting struts 330 and a plurality of shingles 400. In certain embodiments, including the one depicted in FIG. 5, a given tire 400 may be converted into two mounting struts 330 and twelve shingles 400. In FIG. 5A, a structure 510 may be a portion of a roof (not independently illustrated), a portion of a panel (not independently illustrated), or a portion of a modular panel (not independently illustrated) that may be used as part of a larger cladding project. In certain embodiments, structure 510 may include a flat surface (not independently illustrated) such as, for example, a plastic, metal, wood, aluminum, or other layer. In other embodiments, structure 510 may include a flat surface with a number of crossbars 515 disposed on the flat surface. In still other embodiments, structure 510 may be composed of only crossbars 515. One of ordinary skill in the art will recognize that structure 510 may vary in accordance with one or more embodiments of the present invention.

Mounting struts 330 may be fastened to a flat surface (not independently illustrated) of structure 510 or one or more crossbars 515 of structure 510. For example, a first edge groove 355 or a second edge groove 375 may be fastened to the flat surface of structure 510 or one or more crossbars 515 of structure 510. Mounting strut 330 may be positioned such that mounting strut 330 protrudes longitudinally. The second edge groove 375 or the first edge groove 355 may then be fastened to the flat surface of structure 510 or one or more crossbars 515 of structure 510 to maintain the protruding shape of mounting strut 330. In FIG. 5A, two mounting struts 330 are depicted fastened to one or more crossbars 515 of structure 510 such that mounting struts 330 protrude longitudinally and mounting groove 530 is formed in the aperture or space between them and on either side of them. The mounting groove 530 may be the aperture or space between two mounting struts 330, or the aperture or space between a mounting strut 330 and an edge (not shown) of structure 510, that exposes a portion of the flat surface of structure 510 or one or more crossbars 515 of structure 510 suitable for mounting a shingle 400. In certain embodiments, mounting struts 330 may be placed such that the mounting groove 530 formed between them includes an aperture or space that may be substantially covered by a shingle 400.

Figure 5B:
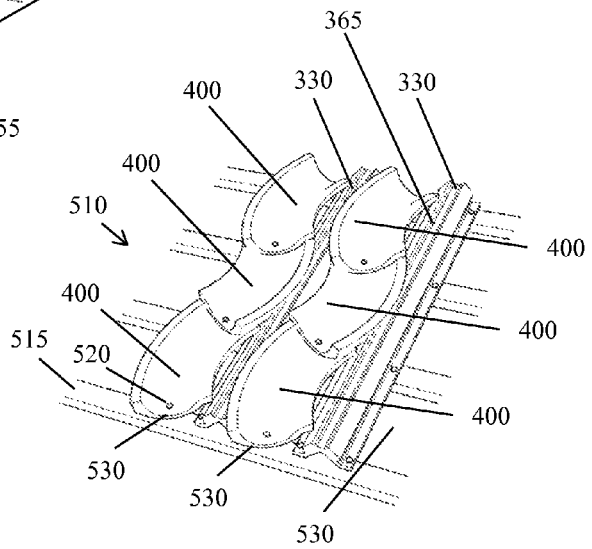
FIG. 5B shows the plurality of mounting struts and a plurality of interior-facing shingles fastened to the structure in accordance with one or more embodiments of the present invention.

Continuing in FIG. 5B, a plurality of interior-facing shingles 400 may be fastened to the flat surface of structure 510 or one or more crossbars 515 of structure 510 in one or more mounting grooves 530 formed by one or more mounting struts 330. Interior-facing shingles 400 are shingles 400 placed such that an interior portion of the source tire (100 of FIG. 1) is outward facing. In certain embodiments, the interior-facing shingles 400 may be fastened to structure 510 starting at an edge of structure 510 and continuing in sequence along a length of mounting groove 530. One of ordinary skill in the art will recognize that interior-facing shingles 400 may be fastened to structure 510 starting at other locations in accordance with one or more embodiments of the present invention. Each subsequently placed interior-facing shingle 400 may be rotated with respect to a previously placed interior-facing shingle 400 and overlap the previously placed interior-facing shingle 400. In this way, a plurality of interior-facing shingles 400 may be fastened to structure 510 in mounting groove 530 that spans a length of mounting strut 330. Because each successive interior-facing shingle 400 is rotated and overlapping, the plurality of interior-facing shingles 400 may form a substantially arcuate profile, which, in one example, forms an approximately sinusoidal-type pattern.

For example, a first end of a first interior-facing shingle 400 may be fastened to a lower edge of the flat surface of structure 510 or a crossbar 515 of structure 510 in mounting groove 530 by a fastener 520. A second interior-facing shingle 400 may be rotated relative to the first interior-facing shingle and placed such that a first end of the second interior-facing shingle 400 overlaps a second end of the first interior-facing shingle 400. The first end of the second interior-facing shingle 400 and the second end of the first interior-facing shingle 400 may be fastened by a fastener 520 to the flat surface of structure 510 or a crossbar 515 of structure 510. A third interior-facing shingle 400 may be rotated relative to the second interior-facing shingle and placed such that a first end of the third-interior facing shingle 400 overlaps a second end of the second interior-facing shingle 400. The first end of the third interior-facing shingle 400 and the second end of the second interior-facing shingle 400 may be fastened by a fastener 520 to the flat surface of structure 510 or a crossbar 515 of structure 510. A second end of the third interior-facing shingle 400 may be fastened by a fastener 520 to the flat surface of structure 510 or a crossbar 515 of structure 510. In this way, three interior-facing shingles 400 may be fastened in a mounting groove 530 that spans a length of mounting strut 330. This process may be continued to place as many interior-facing shingles 400 as may be necessary to cover the mounting grooves 530 for a given structure 510. As discussed above with respect to FIG. 4, the removal of portions of the tread tip (410 and 420 of FIG. 4) may improve the overlapping of interior-facing shingles 400 and/or their aesthetic appeal.

Figure 5C:
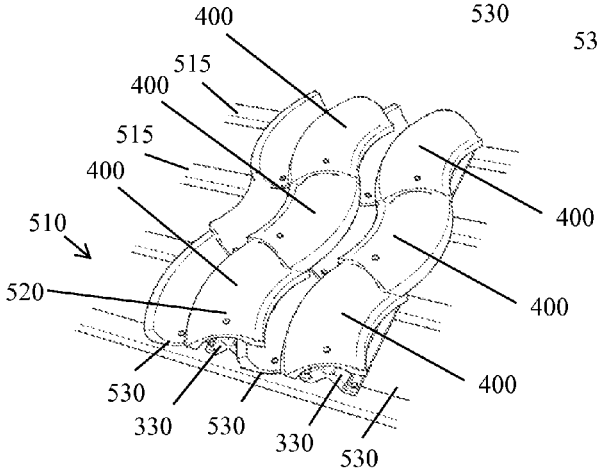
FIG. 5C shows the plurality of mounting struts, the plurality of interior-facing shingles, and a plurality of exterior-facing shingles fastened to the structure in accordance with one or more embodiments of the present invention.

Continuing in FIG. 5C, a plurality of exterior-facing singles 400 may be fastened to structure 510 through mounting struts 330. Exterior facing shingles 400 are shingles 400 placed such that an exterior portion of the source tire (100 of FIG. 1) is outward facing. The exterior-facing shingles 400 may be fastened to structure 510 starting at the edge of structure 510 and continuing in sequence along a length of mounting strut 330. One of ordinary skill in the art will recognize that exterior-facing shingles 400 may be fastened to structure 510 starting at other locations in accordance with one or more embodiments of the present invention. In certain embodiments, an exterior-facing shingle 400 may be fastened to structure 510 by a fastener 520 that extends through shingle 400 into center groove 365 of mounting strut 330 that is itself fastened to structure 510. In other embodiments, an exterior-facing shingle 400 may be fastened to structure 510 by a fastener 520 that extends through shingle 400 and center groove 365 of mounting strut 330 into structure 510. Each subsequently placed exterior-facing shingle 400 may be rotated with respect to a previously placed exterior-facing shingle 400 and overlap the previously placed exterior-facing shingle 400. In this way, a plurality of exterior-facing shingles 400 may be fastened to structure 510 along a length of mounting strut 330. Because each successive exterior-facing shingle 400 is rotated and overlapping, the plurality of exterior-facing shingles 400 may form a substantially arcuate profile, which, in one example, forms an approximately sinusoidal-type pattern.

For example, a first exterior-facing shingle 400 may be oriented such that its orientation matches that of the underlying interior-facing shingles 400 that it will partially cover. In certain embodiments, a first end of the first exterior-facing shingle 400 may be fastened to mounting strut 330 through a center groove 365 of mounting strut 330 by a fastener 520. The center groove 365 may ease fastening shingle 400 to structure 510, but may not be necessary in all embodiments. If mounting strut 330 does not include center groove 365, an approximate longitudinal centerline of mounting strut 330 may be used in its place. In other embodiments, a first end of the first exterior-facing shingle 400 may be fastened to the flat surface of structure 510 or a crossbar 515 of structure 510 through center groove 365 of mounting strut 330 by a fastener 520. A second exterior-facing shingle 400 may be rotated relative to the first exterior-facing shingle 400 and placed such that a first end of the second exterior-facing shingle 400 overlaps a second end of the first exterior-facing shingle 400. In certain embodiments, the first end of the second exterior-facing shingle 400 and the second end of the first exterior-facing shingle 400 may be fastened to mounting strut 330 through center groove 365 of mounting strut 330 by a fastener 520. In other embodiments, the first end of the second exterior-facing shingle 400 and the second end of the first exterior-facing shingle may be fastened to the flat surface of structure 510 or a crossbar 515 of structure 510 through mounting strut 330. A third exterior-facing shingle 400 may be rotated relative to the second exterior-facing shingle 400 and placed such that a first end of the third exterior-facing shingle 400 overlaps a second end of the second exterior-facing shingle 400. In certain embodiments, the first end of the third exterior-facing shingle 400 and the second end of the second exterior-facing shingle 400 may be fastened to mounting strut 330 through center groove 365 of mounting strut 330 by a fastener 520. In other embodiments, the first end of the third exterior-facing shingle 400 and the second end of the second exterior-facing shingle 400 may be fastened to the flat surface of structure 510 or a crossbar 515 of structure 510 through mounting strut 330. In certain embodiments, the second end of the third-exterior facing shingle 400 may be fastened to mounting strut 330 through center groove 365 of mounting strut 330 by a fastener 520. In other embodiments, the second end of the third-exterior facing shingle 400 may be fastened to the flat surface of structure 510 or a crossbar 515 of structure 510 through mounting strut 330. In this way, three exterior-facing shingles 400 may be fastened along a length of mounting strut 330. This process may be continued to place as many exterior-facing shingles 400 as may be necessary to cover the mounting struts 330 for a given structure 510. As discussed above with respect to FIG. 4, the removal of portions of the tread tip (410 and 420 of FIG. 4) may improve the overlapping of exterior-facing shingles 400 and/or their aesthetic appeal.

As shown in FIG. 5C, the cladding formed using cladding components formed by a method of converting a tire into cladding components may facilitate water flow over structure 510. A substantially U-shaped bottom layer may be formed by each column of overlapping interior-facing shingles 400 and a substantially upside-down U-shaped top layer may be formed by each column of overlapping exterior-facing shingles 400. The exterior-facing shingles 400 may be supported by the arch of mounting struts 330. Because the upside-down U-shaped exterior-facing shingles 400 overlap the U-shaped interior-facing shingles 400, water flow may be facilitated. Water may roll over upside-down U-shaped exterior-facing shingles 400 into U-shaped interior-facing shingles 400. Because the shingles 400 are placed in an overlapping manner, water may flow down the reservoir formed by the overlapping interior-facing shingles 400 and off of structure 510. In addition to functionality, the cladding formed using cladding components formed by a method of converting a tire into cladding components may provide an aesthetically pleasing decoration of the cladding. In certain embodiments, the cladding may have an approximately sinusoidal-type pattern because of the shape and orientation of the shingles 400.

In certain embodiments, fasteners 520 may be nails. In other embodiments, fasteners 520 may be rivets, staples, screws, glue, chemical bonding material, thermal bonding material, or other mechanical fasteners. One of ordinary skill in the art will recognize that other types of fasteners may be used in accordance with one or more embodiments of the present invention.

Figure 6A:
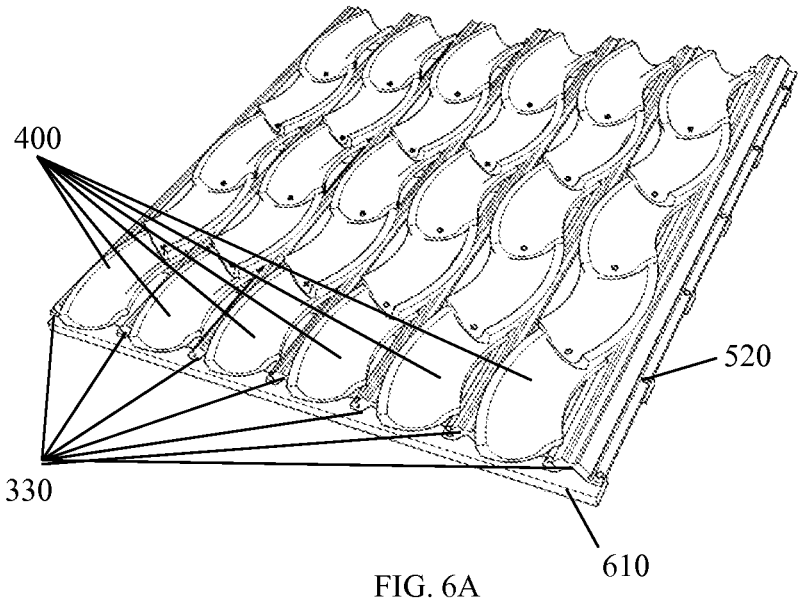
FIG. 6A shows a plurality of mounting struts and a plurality of interior-facing shingles mounted to a cladding panel in accordance with one or more embodiments of the present invention.

FIG. 6 shows a cladding panel in accordance with one or more embodiments of the present invention. In certain embodiments, a modular backing structure 610 may be used to facilitate the manufacture of modular cladding panel 600. Modular backing structure 610 may be composed of a somewhat rigid layer of plastic, metal, wood, aluminum, or any other backing material suitable to support cladding panel 600. In FIG. 6A, a plurality of mounting struts 330 are fastened to modular backing structure 610 by a plurality of fasteners 520. The plurality of mounting struts 330 are spaced out such that the mounting grooves (530 of FIG. 5) disposed between mounting struts 330 are of a width that may be substantially covered by a shingle 400. A plurality of interior-facing shingles 400 may be fastened to structure 610 in one or more mounting grooves (530 of FIG. 5) formed by the mounting struts 330. The interior-facing shingles 400 may be fastened to structure 610 starting at an edge of structure 610 and continuing in sequence along a mounting groove (530 of FIG. 5). Each subsequently placed interior-facing shingle 400 may be rotated with respect to a previously placed interior-facing shingle 400 and overlap the previously placed interior-facing shingle 400. In this way, a plurality of interior-facing shingles 400 may be fastened in mounting grooves (530 of FIG. 5) that spans a length of mounting struts 330.

Figure 6B:
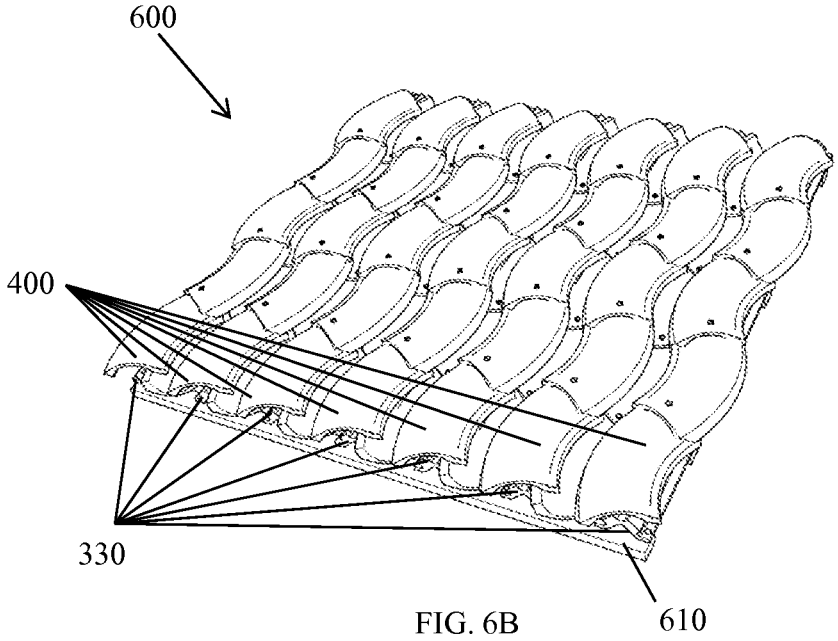
FIG. 6B shows the plurality of mounting struts, the plurality of interior-facing shingles, and a plurality of exterior-facing shingles mounted to the cladding panel in accordance with one or more embodiments of the present invention.

In FIG. 6B, a plurality of exterior-facing singles 400 may be fastened to structure 610 through a center groove (365 of FIGS. 3 and 5) of mounting struts 330. The exterior-facing shingles 400 may be fastened to structure 610 starting at the edge of structure 610 continuing in sequence along a length of mounting struts 330. One of ordinary skill in the art will recognize that exterior-facing shingles 400 may be fastened to structure 610 starting at other locations in accordance with one or more embodiments of the present invention. Each subsequently placed exterior-facing shingle 400 may be rotated with respect to a previously placed exterior-facing shingle 400 and overlap the previously placed exterior-facing shingle 400. In this way, a plurality of exterior-facing shingles 400 may be fastened to structure 610 along a length of mounting struts 330.

Cladding panel 600 may be used as part of a larger cladding project. For example, a plurality of cladding panels 600 may be manufactured in advance of a cladding project. The plurality of cladding panels 600 may be stored until needed and transported to a location for a cladding project. The plurality of cladding panels 600 may be arranged such that the plurality of cladding panels 600 provides sufficient cladding coverage for a given cladding project.

Figure 7A:
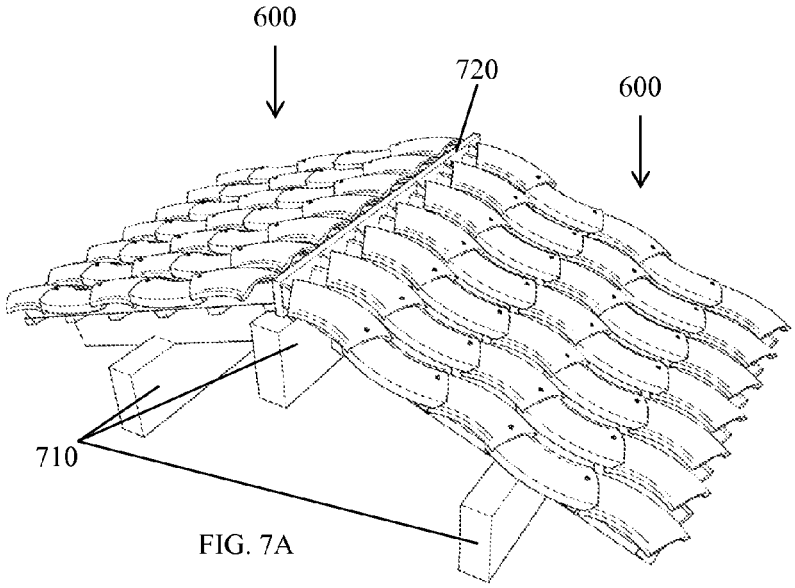
FIG. 7A shows cladding that meet at a ridge joint in accordance with one or more embodiments of the present invention.
Figure 7B:
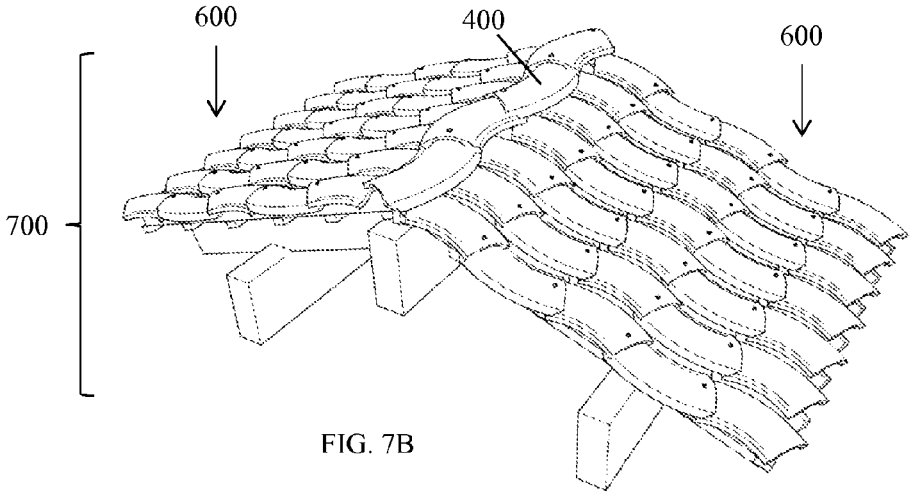
FIG. 7B shows a plurality of exterior-facing shingles fastened to the ridge joint in accordance with one or more embodiments of the present invention.

FIG. 7 shows a ridge joint of cladding in accordance with one or more embodiments of the present invention. In FIG. 7A, a plurality of cladding panels 600 may be used as part of a cladding used for roofing a structure 710. A ridge joint 720 may be formed by two cladding panels 600 arranged in a common angle. In this way, two pre-manufactured cladding panels 600 may be fastened to structure 710 and meet at a ridge joint 720 formed by a member (not independently illustrated) that spans the ridge (not independently illustrated). Continuing in FIG. 7B, a plurality of exterior-facing shingles 400 may be fastened to ridge joint 720, thereby providing proper water flow and an aesthetic appeal to the roofing structure 700. In certain embodiments, a ridge joint (720 of FIG. 7A) may be formed by cladding components that are assembled on site on an interior or exterior panel or roof. One of ordinary skill in the art will recognize that ridge joints 720 may be utilized in other ways in accordance with one or more embodiments of the present invention.

Figure 8A:
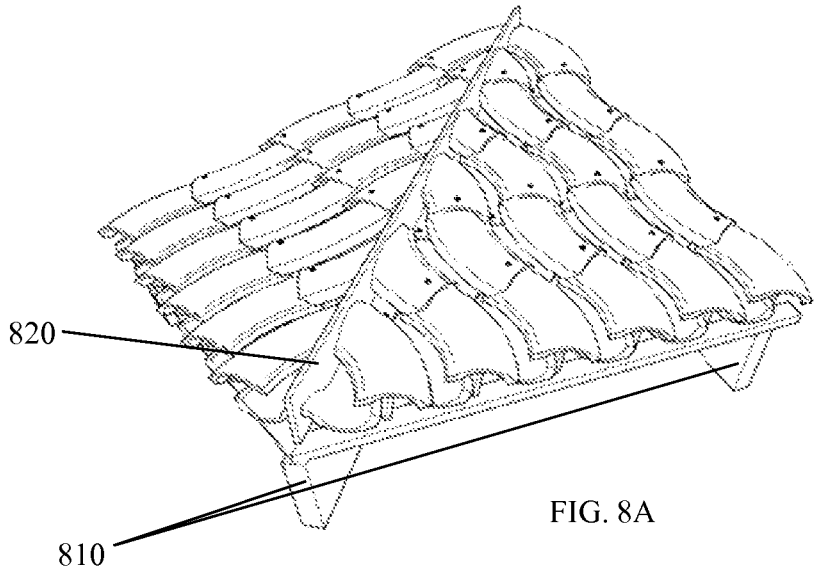
FIG. 8A shows cladding that meet at a hip joint in accordance with one or more embodiments of the present invention.
Figure 8B:
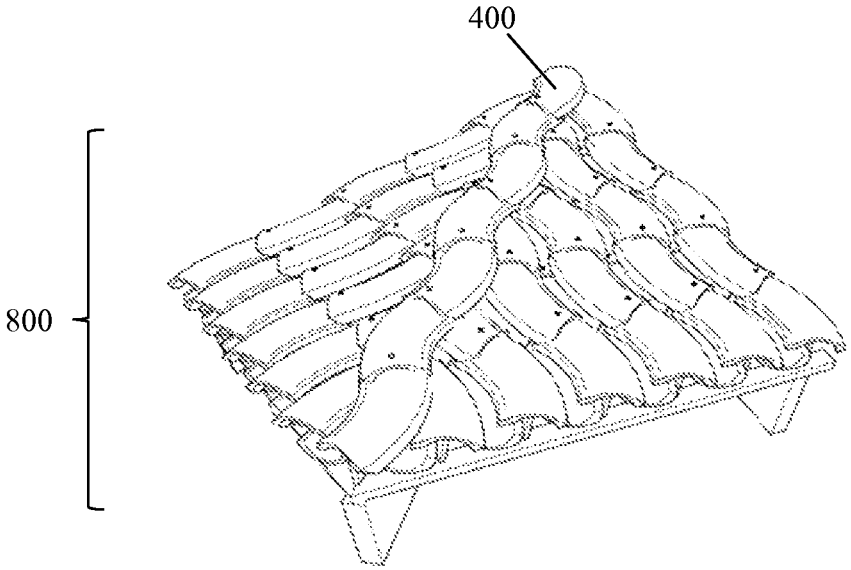
FIG. 8B shows a plurality of exterior-facing shingles fastened to the hip joint in accordance with one or more embodiments of the present invention.

FIG. 8 shows a hip joint of cladding in accordance with one or more embodiments of the present invention. In FIG. 8A, cladding components (not independently illustrated) disposed on a structure 810 may meet at a hip joint 820. Hip joint 820 may be formed by a corner of cladding disposed on structure 810. On either side of hip joint 820, cladding components (not independently illustrated) may be placed along a respective side of hip joint 820. The cladding components (not independently illustrated) may be fastened to structure 810 in a similar manner to that discussed above with respect to FIG. 5. However, in this instance, because of the corner, the mounting struts (not independently illustrated) on a given side of hip joint may vary in length. Continuing in FIG. 8B, a plurality of exterior-facing shingles 400 may be fastened to hip joint 820, thereby providing proper water flow and an aesthetic appeal to the roofing structure 800.

Figure 9:
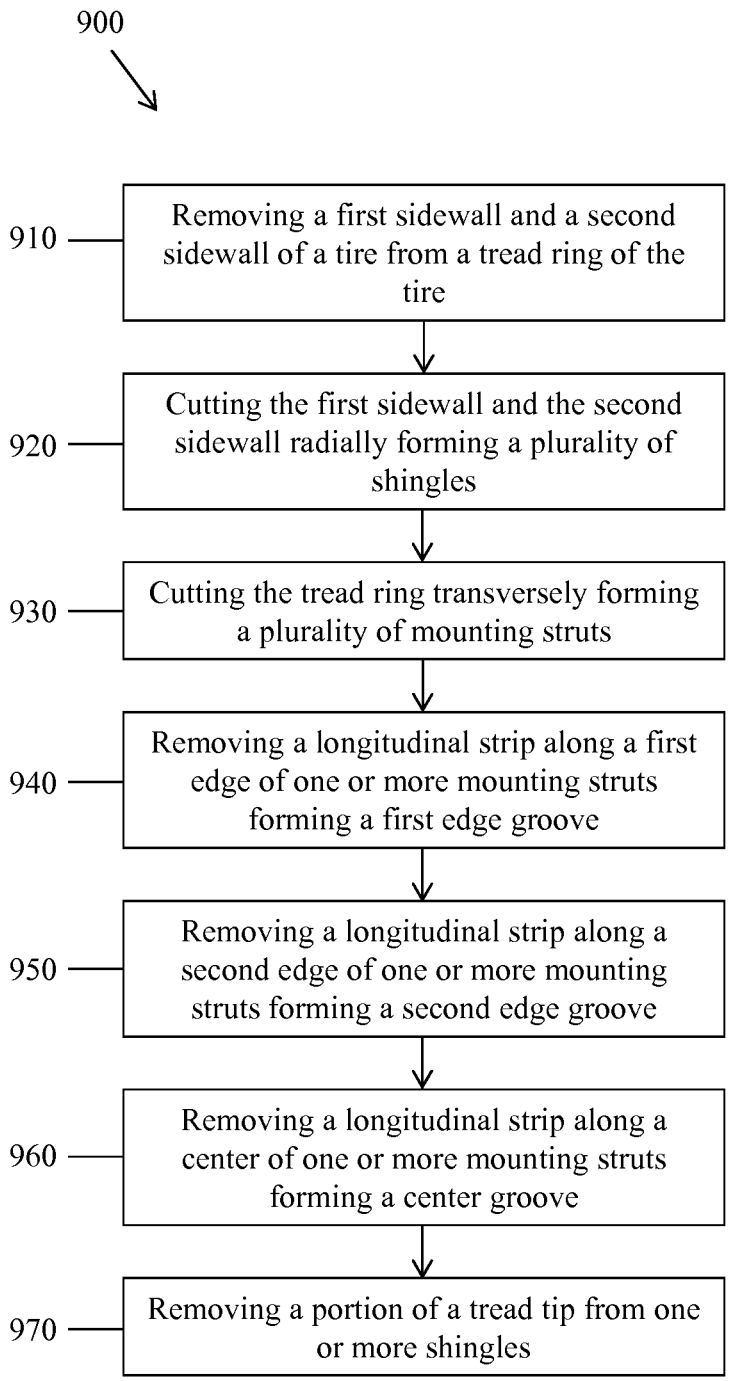
FIG. 9 shows a method of converting a tire into cladding components in accordance with one or more embodiments of the present invention.

FIG. 9 shows a method of converting a tire into cladding components in accordance with one or more embodiments of the present invention. The method 900 may be used to convert a tire into cladding components as shown in FIGS. 2, 3, and 4 and as discussed above. In step 910, a first sidewall and a second sidewall of a disposed tire may be removed from a tread ring of the tire. The first sidewall may be removed from the tread ring at a circumferential location. The second sidewall may be removed from the tread ring at a circumferential location. In certain embodiments, the first sidewall may be removed from the tread ring at a circumferential location that extends approximately 2 inches from the first sidewall portion into the tread portion of the tire and the second sidewall may be removed from the tread ring at a circumferential location that extends approximately 2 inches from the second sidewall portion into the tread portion of the tire. In this way, the first sidewall and the second sidewall each include a portion of tread along their outer circumference. The portion of tread left on the first sidewall and the portion of the tread left on the second sidewall may form a lip on the shingles eventually produced. In other embodiments, the first sidewall may be removed from the tread ring at a circumferential location that extends approximately 1 inch from the first sidewall portion into the tread portion of the tire and the second sidewall may be removed from the tread ring at a circumferential location that extends approximately 1 inch from the second sidewall portion into the tread portion of the tire. One of ordinary skill in the art will recognize that circumferential locations may vary in accordance with a specific design or application. In certain embodiments, a cutting tool or cutter may be used to remove the first sidewall and the second sidewall from the tread ring. In other embodiments, a milling tool may be used. In still other embodiments, a saw may be used. One of ordinary skill in the art will recognize that any cutting mechanism suitable for removing the first sidewall and the second sidewall from the tread ring may be used in accordance with one or more embodiments of the present invention.

In step 920, the first sidewall and the second sidewall may be cut radially forming a plurality of shingles. The first sidewall may be cut radially forming a plurality of shingles. The second sidewall may be cut radially forming a plurality of shingles. The radial cuts may be made along a plurality of lines that run through a center of the circumference of each respective sidewall piece. In certain embodiments, twelve shingles may be formed by making six radial cuts on the first sidewall that are approximately equidistant apart and making six radial cuts on the second sidewall that are approximately equidistant apart. In other embodiments, a plurality of shingles may be formed by making a corresponding plurality of radial cuts on each respective sidewall piece that are approximately equidistant apart. One of ordinary skill in the art will recognize that the number of shingles formed depends on the number of radial cuts made and may vary in accordance with a specific design or application. In addition, one of ordinary skill in the art will recognize that the size of the shingles may vary based on the spacing between the radial cuts and may vary in accordance with a specific design or application. In certain embodiments, a cutting tool or cutter may be used to make the radial cuts forming the plurality of shingles. In other embodiments, a milling tool may be used. In still other embodiments, a saw may be used. One of ordinary skill in the art will recognize that any cutting mechanism suitable for making radial cuts may be used in accordance with one or more embodiments of the present invention.

In step 930, the tread ring may be cut transversely forming a plurality of mounting struts. In certain embodiments, the tread ring may be cut transversely at two locations that are approximately equidistant apart. In this way, two mounting struts of approximately equal length may be formed out of the tread ring. In other embodiments, the tread ring may be cut transversely at a plurality of locations that are approximately equidistant apart, forming a plurality of mounting struts that are approximately equal in length. One of ordinary skill in the art will recognize that the tread ring may be cut transversely at different locations forming mounting struts of different lengths that may vary in accordance with a specific design or application.

While the mounting struts may be used without further modification, in certain embodiments, the mounting struts may be modified to facilitate the fastening of the mounting struts to an underlying structure and/or to facilitate the fastening of shingles to the mounting strut itself or the underlying structure through the mounting struts. In step 940, a longitudinal strip may be removed along a first edge of one or more mounting struts forming a first edge groove in the one or more mounting struts. In step 950, a longitudinal strip may be removed along a second edge of one or more mounting struts forming a second edge groove in the one or more mounting struts. In step 960, a longitudinal strip may be removed along a center of one or more mounting struts forming a center groove in the one or more mounting struts. In certain embodiments, a groove forming tool may be used remove the longitudinal strips. In other embodiments, a cutting tool or cutter may be used. In still other embodiments, a milling tool may be used. One of ordinary skill in the art will recognize that any cutting mechanism suitable for removing longitudinal strips from the one or more mounting struts may be used in accordance with one or more embodiments of the present invention.

The shingles and mounting struts made out of the tire may be used as cladding components for manufacturing a cladding or cladding panel. In certain embodiments, the cladding components may be used as cladding components for roofing. In other embodiments, the cladding components may be used as cladding components for a panel. In still other embodiments, the cladding components may be used as cladding components for a modular cladding panel configured to facilitate the assembly of a larger cladding. One of ordinary skill in the art will recognize that the use of the cladding components may vary based on a specific design or application.

In certain embodiments, an appearance of one or more shingles may be altered by cutting an outward facing surface and/or edge of the one or more shingles. For example, the surface and/or edge may be straight-cut, scalloped, or pointed. In other embodiments, an appearance of one or more shingles may be altered by shaving an outward facing surface and/or edge of the one or more shingles. In still other embodiments, an appearance of one or more shingles may be altered by buffing an outward facing surface and/or edge of the one or more shingles. In still other embodiments, an appearance of one or more shingles may be altered by heating an outward facing surface and/or edge of the one or more shingles. In this way, the outward facing surface and/or edge may be altered to ensure an approximately uniform appearance of the one or more shingles or provide an approximately uniform aesthetic look to the one or more shingles.

In certain embodiments, the above-noted alterations to the outward facing surfaces and/or edges of one or more shingles may be performed prior to removal of the first and second sidewalls from the tread ring. In other embodiments, the above-noted alterations to the outward facing surfaces and/or edges of one or more shingles may be performed after removal of the first and second sidewalls from the tread ring, but prior to the cutting the respective sidewalls into shingles. In still other embodiments, the above-noted alterations to the outward facing surfaces and/or edges of one or more shingles may be performed on one or more shingles after they are formed. One of ordinary skill in the art will recognize that the manner in which the outward facing surface and/or edge of shingles may be altered may vary in accordance with one or more embodiments of the present invention.

In step 970, a portion of a tread tip may be removed from one or more shingles. As discussed above, the first sidewall and second sidewall may be removed from the tread ring at circumferential locations that extend into the tread portion of the tire. As such, the first sidewall and the second sidewall may each include a portion of tread along their outer circumference. The portion of tread left on the first sidewall and the portion of tread left on the second sidewall may form a lip on the shingles formed from each respective sidewall. In certain embodiments, one or more of a portion of a tread tip may be removed from the lip of one or more shingles. The portion of the tread tip may be removed by making a 45 degree angle cut with respect to the portion of tread of shingle when looking at shingle from the perspective of what would be the inside of the tire. The removal of the portions of the tread tip may improve the overlapping of shingles and the aesthetic appeal of the cladding ultimately produced.

Figure 10:
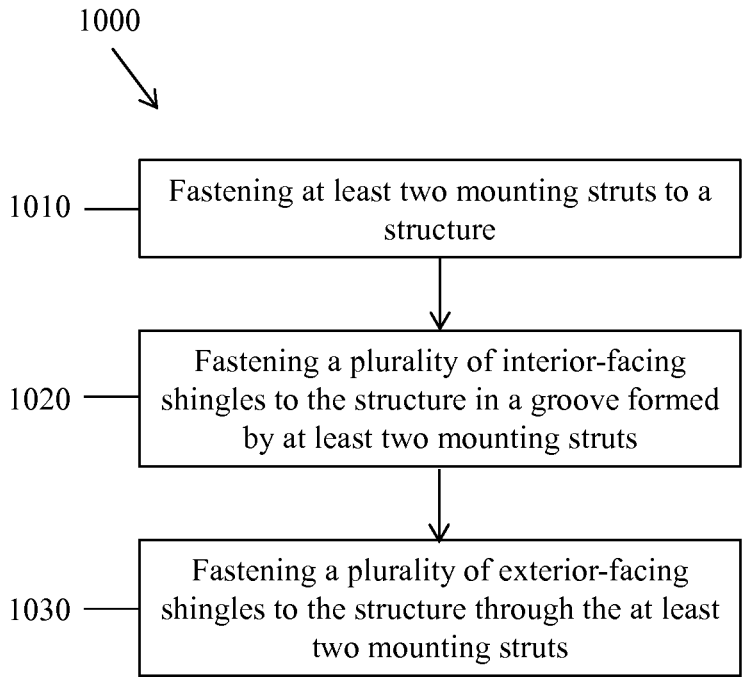
FIG. 10 shows a method of manufacturing a cladding in accordance with one or more embodiments of the present invention.

FIG. 10 shows a method of manufacturing a cladding in accordance with one or more embodiments of the present invention. The method 1000 may be performed using cladding components manufactured by method 900 of converting a tire into cladding components shown in FIGS. 2, 3, 4, and 9 and as discussed above. In addition, the method 1000 may be used to manufacture the claddings shown in FIGS. 5, 6, 7, and 8.

In step 1010, at least two mounting struts may be fastened to a structure. As noted above, a disposed tire may be converted into a plurality of mounting struts and a plurality of shingles. In certain embodiments, a disposed tire may be converted into two mounting struts and twelve shingles. The structure may be a portion of a roof, a portion of a panel, or a portion of a modular panel that may be used as part of a larger cladding project. In certain embodiments, the structure may include a flat surface. In other embodiments, the structure may include a flat surface with a number of crossbars disposed on the flat surface. In still other embodiments, the structure may be composed of only crossbars. One of ordinary skill in the art will recognize that the structure may vary in accordance with one or more embodiments of the present invention. The mounting struts may be fastened to the flat surface of the structure or one or more crossbars of the structure. In certain embodiments, a first edge groove may be fastened to the flat surface of the structure or one or more crossbars of the structure with one or more fasteners and the second edge groove may be fastened to the flat surface of the structure or one or more crossbars of the structure with one or more fasteners. The first edge groove or the second edge groove may be fastened to the flat surface of the structure or one or more crossbars of the structure first. The mounting strut may then be positioned such that a portion of the mounting strut protrudes longitudinally. The second edge groove or the first edge groove may then be fastened to the flat surface of the structure or one or more crossbars of the structure to maintain the protruding shape of the mounting strut. A mounting groove may be the aperture or space between two mounting struts, or the aperture or space between a mounting strut and an edge of the structure, which exposes a portion of the flat surface of the structure or one or more crossbars of the structure suitable for mounting a shingle. In certain embodiments, the mounting struts may be placed such that the mounting groove formed between them includes an aperture or space that may be substantially covered by a shingle.

In step 1020, a plurality of interior-facing shingles may be fastened to the flat surface of the structure or one or more crossbars of the structure in one or more mounting grooves formed by at least two mounting struts. Interior-facing shingles are shingles placed such that an interior portion of the source tire is outward facing. In certain embodiments, the interior-facing shingles may be fastened to the structure starting at an edge of the structure and continuing in sequence along a length of the mounting groove. One of ordinary skill in the art will recognize that interior-facing shingles may be fastened to the structure starting at other locations in accordance with one or more embodiments of the present invention. Each subsequently placed interior-facing shingle may be rotated with respect to a previously placed interior-facing shingle and overlap the previously placed interior-facing shingle. In this way, a plurality of interior-facing shingles may be fastened to the structure in a mounting groove that spans a length of the mounting strut. This process may be continued to place as many interior-facing shingles as may be necessary to cover the mounting grooves for a given structure. Because each successive interior-facing shingle is rotated and overlapping, the plurality of interior-facing shingles may form a substantially arcuate profile, which, in one example, forms an approximately sinusoidal pattern.

In step 1030, a plurality of exterior-facing shingles may be fastened to the structure through the at least two mounting struts. Exterior facing shingles are shingles placed such that an exterior portion of the source tire is outward facing. The exterior-facing shingles may be fastened to the structure starting at the edge of the structure and continuing in sequence along a length of the mounting strut. One of ordinary skill in the art will recognize that exterior-facing shingles may be fastened to the structure starting at other locations in accordance with one or more embodiments of the present invention. In certain embodiments, an exterior-facing shingle may be fastened to the structure by a fastener that extends through the shingle into a center groove of a mounting strut that is itself fastened to the structure. In other embodiments, an exterior-facing shingle may be fastened to the structure by a fastener that extends through the shingle and a center groove of a mounting strut into the structure. Each subsequently placed exterior-facing shingle may be rotated with respect to a previously placed exterior-facing shingle and overlap the previously placed exterior-facing shingle. In this way, a plurality of exterior-facing shingles may be fastened to the structure along a length of the mounting strut. This process may be continued to place as many exterior-facing shingles as may be necessary to cover the mounting struts for a given structure. Because each successive exterior-facing shingle is rotated and overlapping, the plurality of exterior-facing shingles may form a substantially arcuate profile, which, in one example, forms an approximately sinusoidal pattern.

The cladding formed using cladding components formed by a method of converting a tire into cladding components may facilitate water flow over a structure. A substantially U-shaped bottom layer may be formed by each column of overlapping interior-facing shingles and a substantially upside-down U-shaped top layer may be formed by each column of overlapping exterior-facing shingles disposed along a length of the mounting struts. The exterior-facing shingles may be supported by the arch of the mounting struts. Because the upside-down U-shaped exterior-facing shingles overlap the U-shaped interior-facing shingles, water flow may be facilitated. Water may roll over the upside-down U-shaped exterior-facing shingles into U-shaped interior-facing shingles. Because each of the interior-facing shingles and exterior-facing shingles are placed in an overlapping manner, water may flow down the reservoir formed by the overlapping interior-facing shingles and off of the structure. In addition to functionality, the cladding formed using cladding components formed by a method of converting a tire into cladding components may provide an aesthetically pleasing decoration of the cladding. In certain embodiments, the cladding may have an approximately sinusoidal-type pattern because of the shape and orientation of the shingles.

Advantages of one or more embodiments of the present invention may include one or more of the following:

In one or more embodiments of the present invention, a method of converting a tire into cladding components repurposes one or more disposed tires in an environmentally friendly manner.

In one or more embodiments of the present invention, a method of converting a tire into cladding components reduces or eliminates the environmental waste associated with disposal of the tire.

In one or more embodiments of the present invention, a method of converting a tire into cladding components reduces or eliminates the environmental impact associated with disposal of the tire.

In one or more embodiments of the present invention, a method of converting a tire into cladding components does not require reshaping, reconstituting the chemical composition, molding, or compositing the tire.

In one or more embodiments of the present invention, a method of converting a tire into cladding components may use the entire disposed tire to produce cladding components.

In one or more embodiments of the present invention, a method of converting a tire into cladding components produces cladding components that aesthetically resemble conventional cladding.

In one or more embodiments of the present invention, a method of converting a tire into cladding components simplifies the process of converting the tire into the cladding components.

In one or more embodiments of the present invention, a method of converting a tire into cladding components reduces the cost associated with converting the tire into the cladding components.

In one or more embodiments of the present invention, a method of converting a tire into cladding components reduces the amount of energy required to produce the cladding components.

In one or more embodiments of the present invention, a method of converting a tire into cladding components produces cladding components that require substantially less maintenance than conventional cladding components.

In one or more embodiments of the present invention, a method of converting a tire into cladding components produces cladding components that have a substantially longer service life compared to conventional cladding components.

In one or more embodiments of the present invention, a method of converting a tire into cladding components produces cladding components that perform as good as or better than conventional cladding components.

In one or more embodiments of the present invention, a method of converting a tire into cladding components produces cladding components that cost substantially less than conventional cladding components.

In one or more embodiments of the present invention, a method of manufacturing a cladding produces a cladding or cladding panel made of one or more repurposed tires.

In one or more embodiments of the present invention, a method of manufacturing a cladding produces a cladding or cladding panel made of cladding components made by a method of converting a tire into cladding components.

In one or more embodiments of the present invention, a method of manufacturing a cladding produces a cladding or cladding panel that may be modular.

In one or more embodiments of the present invention, a method of manufacturing a cladding produces a cladding or cladding panel that uses repurposed tires in an environmentally friendly manner.

In one or more embodiments of the present invention, a method of manufacturing a cladding produces a cladding or cladding panel that reduces or eliminates the environmental waste associated with disposal of one or more repurposed tires.

In one or more embodiments of the present invention, a method of manufacturing a cladding produces a cladding or cladding panel that reduces or eliminates the environmental impact associated with disposal of one or more repurposed tires.

In one or more embodiments of the present invention, a method of manufacturing a cladding produces a cladding or cladding panel that may use the entirety of one or more disposed tires.

In one or more embodiments of the present invention, a method of manufacturing a cladding produces a cladding or cladding panel that aesthetically resembles conventional cladding.

In one or more embodiments of the present invention, a method of manufacturing a cladding produces a cladding or cladding panel that simplifies the manufacturing process.

In one or more embodiments of the present invention, a method of manufacturing a cladding produces a cladding or cladding panel that reduces the cost associated with manufacturing the cladding or cladding panel.

In one or more embodiments of the present invention, a method of manufacturing a cladding produces a cladding or cladding panel that reduces the amount of energy required to produce the cladding or cladding panel.

In one or more embodiments of the present invention, a method of manufacturing a cladding produces a cladding or cladding panel that requires substantially less maintenance than conventional cladding or cladding panels.

In one or more embodiments of the present invention, a method of manufacturing a cladding produces a cladding or cladding panel that have a substantially longer service life compared to conventional cladding or cladding panels.

In one or more embodiments of the present invention, a method of manufacturing a cladding produces a cladding or cladding panel that perform as good as or better than conventional cladding or cladding panels.

In one or more embodiments of the present invention, a method of manufacturing a cladding produces a cladding or cladding panel that costs substantially less than conventional cladding or cladding panels.

While the present invention has been described with respect to the above-noted embodiments, those skilled in the art, having the benefit of this disclosure, will recognize that other embodiments may be devised that are within the scope of the invention as disclosed herein. Accordingly, the scope of the invention should be limited only by the appended claims.

What is claimed is:

1. A method of converting a tire into cladding components comprising:

removing a first sidewall and a second sidewall of the tire from a tread ring of the tire wherein each sidewall is removed from the tread ring at a circumferential location that is approximately 2 inches into a tread portion of the tire nearest the sidewall;

cutting the first sidewall and the second sidewall radially forming a plurality of shingles, wherein each shingle comprises a portion of tread forming a lip;

removing a portion of a tread tip from the lip of one or more shingles of the plurality of shingles;

cutting the tread ring transversely forming a plurality of mounting struts;

removing a longitudinal strip along a first edge of one or more mounting struts of the plurality of mounting struts forming a first edge groove in the one or more mounting struts; and removing a longitudinal strip along a second edge of the one or more mounting struts forming a second edge groove in the one or more mounting struts; and removing a longitudinal strip along a center of one or more mounting struts of the plurality of mounting struts forming a center groove in the one or more mounting struts.

2. The method of claim 1, wherein 12 shingles are formed by making 6 radial cuts on the first sidewall that are approximately equidistant apart and by making 6 radial cuts on the second sidewall that are approximately equidistant apart.

3. The method of claim 1, wherein 2 mounting struts are formed by making 2 transverse cuts on the tread ring that are approximately equidistant apart.

4. The method of claim 1, wherein an appearance of one or more shingles of the plurality of shingles may be altered by cutting a surface of the one or more shingles.

5. The method of claim 1, wherein an appearance of one or more shingles of the plurality of shingles may be altered by shaving a surface of the one or more shingles.

6. The method of claim 1, wherein an appearance of one or more shingles of the plurality of shingles may be altered by buffing a surface of the one or more shingles.

7. The method of claim 1, wherein an appearance of one or more shingles of the plurality of shingles is altered by heating a surface of the one or more shingles.

8. The method of claim 1, wherein an appearance of one or more shingles of the plurality of shingles is altered by cutting an edge of the one or more shingles in a pattern.

* * * * *